US011920343B2

(12) United States Patent
Pilz

(10) Patent No.: US 11,920,343 B2
(45) Date of Patent: Mar. 5, 2024

(54) FIRE-RATED WALL JOINT COMPONENT AND RELATED ASSEMBLIES

(71) Applicant: CEMCO, LLC, City of Industry, CA (US)

(72) Inventor: Donald Anthony Pilz, Livermore, CA (US)

(73) Assignee: CEMCO, LLC, City of Industry, CA (US)

( * ) Notice: Subject to any disclaimer, the term of this patent is extended or adjusted under 35 U.S.C. 154(b) by 0 days.

(21) Appl. No.: 17/108,966

(22) Filed: Dec. 1, 2020

(65) Prior Publication Data

US 2021/0164222 A1 Jun. 3, 2021

Related U.S. Application Data

(60) Provisional application No. 62/942,423, filed on Dec. 2, 2019.

(51) Int. Cl.
*E04B 1/94* (2006.01)
*E04B 2/74* (2006.01)

(52) U.S. Cl.
CPC ..... *E04B 1/948* (2013.01); *E04B 1/943* (2013.01)

(58) Field of Classification Search
CPC ..... E04B 2/7411; E04B 2/7457; E04B 1/943; E04B 1/948
USPC ..... 52/272
See application file for complete search history.

(56) References Cited

U.S. PATENT DOCUMENTS

| | | | | |
|---|---|---|---|---|
| 661,832 | A | 11/1900 | Wilkinson | |
| 716,628 | A | 12/1902 | Dickey | |
| 965,595 | A | 7/1910 | Nicholson | |
| 1,130,722 | A | 3/1915 | Fletcher | |
| 1,563,651 | A | 12/1925 | Pomerantz | |
| 1,719,728 | A | 7/1929 | Saunders | |
| 2,020,576 | A | 11/1935 | Runde | |
| 2,105,771 | A | 1/1938 | Holdsworth | |
| 2,114,386 | A * | 4/1938 | Killion | E04B 2/7854 52/601 |
| 2,218,426 | A | 10/1940 | Hulbert, Jr. | |

(Continued)

FOREIGN PATENT DOCUMENTS

| | | | |
|---|---|---|---|
| CA | 2234347 | 10/1999 | |
| CA | 2498537 A1 * | 8/2006 | E04B 2/767 |

(Continued)

OTHER PUBLICATIONS

U.S. Appl. No. 17/129,511, filed Dec. 21, 2020 Pilz.

(Continued)

*Primary Examiner* — Brian D Mattei
*Assistant Examiner* — Joseph J. Sadlon
(74) *Attorney, Agent, or Firm* — Knobbe, Martens, Olson & Bear LLP

(57) ABSTRACT

A fire-rated component for a linear gap between a wall assembly and an adjacent structure. The component includes an elongate metal profile and a fire-rated board member. The elongate metal profile has a vertical leg, an upper leg and a lower leg. The upper leg extends in a first direction from an upper edge of the vertical leg. The lower leg extends in the first direction from a lower edge of the vertical leg. The fire-rated board member is positioned within a space defined by the vertical leg, the upper leg and the lower leg.

19 Claims, 4 Drawing Sheets

(56) References Cited

U.S. PATENT DOCUMENTS 2,556,878 A 6/1951 Kohlhaas
2,664,739 A 1/1954 Marcy
2,683,927 A 7/1954 Maronek
2,688,927 A 9/1954 Nuebling
2,733,786 A 2/1956 Drake
2,994,114 A * 8/1961 Black ..... E04B 1/941 52/317
3,041,682 A * 7/1962 Alderfer ..... E06B 7/231 428/129
3,129,792 A 4/1964 Gwynne
3,153,467 A * 10/1964 Nelsson ..... E04B 2/825 52/241
3,271,920 A 9/1966 Downing, Jr.
3,309,826 A 3/1967 Zinn
3,324,615 A 6/1967 Zinn
3,346,909 A 10/1967 Blackburn
3,355,852 A 12/1967 Lally
3,397,495 A 8/1968 Thompson
3,460,302 A 8/1969 Cooper
3,481,090 A 12/1969 Lizee
3,493,460 A 2/1970 Windecker
3,495,417 A 2/1970 Ratliff
3,537,219 A 11/1970 Navarre
3,562,985 A 2/1971 Nicosia
3,566,559 A 3/1971 Dickson
3,600,854 A * 8/1971 Dallaire ..... E06B 3/4681 49/419
3,604,167 A 9/1971 Hays
3,609,933 A * 10/1971 Jahn et al. ..... E04B 2/60 52/461
3,648,419 A 3/1972 Marks
3,668,041 A 6/1972 Lonning
3,683,569 A 8/1972 Holm
3,696,569 A * 10/1972 Didry ..... E04B 2/7854 52/204.593
3,707,819 A 1/1973 Calhoun et al.
3,713,263 A 1/1973 Mullen
3,730,477 A 5/1973 Wavrunek
3,744,199 A 7/1973 Navarre
3,757,480 A 9/1973 Young
3,786,604 A 1/1974 Kramer
3,837,126 A 9/1974 Voiturier et al.
3,839,839 A 10/1974 Tillisch et al.
3,866,370 A * 2/1975 Guarino ..... E04B 2/822 52/241
3,908,328 A 9/1975 Nelsson
3,921,346 A 11/1975 Sauer et al.
3,922,830 A 12/1975 Guarino et al.
3,934,066 A 1/1976 Murch
3,935,681 A 2/1976 Voiturier et al.
3,950,912 A * 4/1976 Lundberg ..... E04B 1/82 D25/123
3,955,330 A 5/1976 Wendt
3,964,214 A 6/1976 Wendt
3,974,607 A 8/1976 Balinski
3,976,825 A 8/1976 Anderberg
3,998,027 A * 12/1976 Wendt ..... E04B 2/825 52/716.1
4,011,704 A 3/1977 O'Konski
4,017,090 A 4/1977 Cohen
4,103,463 A 8/1978 Dixon
4,122,203 A 10/1978 Stahl
4,130,972 A * 12/1978 Varlonga ..... E04B 2/7411 52/241
4,139,664 A 2/1979 Wenrick
4,144,335 A 3/1979 Edwards
4,144,385 A 3/1979 Downing
4,152,878 A 5/1979 Balinski
4,164,107 A 8/1979 Kraemling et al.
4,178,728 A 12/1979 Ortmanns et al.
4,197,687 A 4/1980 Benoit
4,203,264 A 5/1980 Kiefer et al.
4,205,498 A * 6/1980 Unayama ..... E04B 2/822 52/243.1
4,217,731 A 8/1980 Saino
4,269,890 A 5/1981 Breitling et al.
4,276,332 A 6/1981 Castle
4,281,494 A 8/1981 Weinar
4,283,892 A 8/1981 Brown
4,295,304 A 10/1981 Kim
4,318,253 A 3/1982 Wedel
4,324,835 A 4/1982 Keen
4,329,820 A 5/1982 Wendt
4,356,672 A 11/1982 Beckman et al.
4,361,994 A * 12/1982 Carver ..... E04B 2/7455 52/238.1
4,424,653 A 1/1984 Heinen
4,433,732 A 2/1984 Licht et al.
4,434,592 A 3/1984 Reneault et al.
4,437,274 A 3/1984 Slocum et al.
4,454,690 A 6/1984 Dixon
4,461,120 A 7/1984 Hemmerling
4,467,578 A 8/1984 Weinar
4,480,419 A 11/1984 Crites
4,495,238 A 1/1985 Adiletta
4,497,150 A 2/1985 Wendt et al.
4,507,901 A 4/1985 Carroll
4,509,559 A 4/1985 Cheetham et al.
4,517,782 A 5/1985 Shamszadeh
4,574,454 A 3/1986 Dyson
4,575,979 A 3/1986 Mariani
4,578,913 A * 4/1986 Eich ..... E04B 1/941 52/206
4,598,516 A 7/1986 Groshong
4,622,791 A 11/1986 Cook et al.
4,622,794 A 11/1986 Geortner
4,632,865 A 12/1986 Tzur
4,649,089 A 3/1987 Thwaites
4,663,204 A 5/1987 Langham
4,672,785 A 6/1987 Salvo
4,709,517 A 12/1987 Mitchell et al.
4,711,183 A 12/1987 Handler et al.
4,723,385 A 2/1988 Kallstrom
4,756,945 A 7/1988 Gibb
4,761,927 A 8/1988 O'Keeffe et al.
4,787,767 A 11/1988 Wendt
4,798,035 A 1/1989 Mitchell et al.
4,805,364 A 2/1989 Smolik
4,810,986 A 3/1989 Leupold
4,822,659 A 4/1989 Anderson et al.
4,825,610 A 5/1989 Gasteiger
4,830,913 A 5/1989 Ortmans et al.
4,845,904 A 7/1989 Menchetti
4,850,173 A 7/1989 Beyer et al.
4,850,385 A 7/1989 Harbeke
4,854,096 A 8/1989 Smolik
4,854,107 A 8/1989 Roberts
4,866,898 A 9/1989 LaRoche et al.
4,881,352 A 11/1989 Glockenstein
4,885,884 A 12/1989 Schilger
4,897,976 A * 2/1990 Williams ..... E04B 2/7453 52/281
4,899,510 A 2/1990 Propst
4,914,880 A 4/1990 Albertini
4,918,761 A 4/1990 Harbeke
4,930,276 A 6/1990 Bawa et al.
4,935,281 A 6/1990 Tolbert et al.
4,982,540 A 1/1991 Thompson
4,986,040 A 1/1991 Prewer et al.
4,987,719 A 1/1991 Goodson, Jr.
4,992,310 A 2/1991 Gelb et al.
5,010,702 A 4/1991 Daw et al.
5,058,342 A 10/1991 Crompton
5,090,170 A 2/1992 Propst
5,094,780 A 3/1992 von Bonin
5,103,589 A 4/1992 Crawford
5,105,594 A 4/1992 Kirchner
5,111,579 A 5/1992 Andersen
5,125,203 A 6/1992 Daw
5,127,203 A 7/1992 Paquette
5,127,760 A 7/1992 Brady
5,140,792 A 8/1992 Daw et al.
5,146,723 A 9/1992 Greenwood et al.

(56) References Cited

U.S. PATENT DOCUMENTS 5,152,113 A 10/1992 Guddas
5,155,957 A 10/1992 Robertson et al.
5,157,883 A 10/1992 Meyer
5,157,887 A * 10/1992 Watterworth, III ..... E04C 5/065 52/340
5,167,876 A 12/1992 Lem
5,173,515 A 12/1992 von Bonin et al.
5,203,132 A 4/1993 Smolik
5,205,099 A 4/1993 Grünhage et al.
5,212,914 A 5/1993 Martin et al.
5,214,894 A 6/1993 Glesser-Lott
5,222,335 A 6/1993 Petrecca
5,228,254 A 7/1993 Honeycutt, Jr.
5,244,709 A 9/1993 Vanderstukken
5,279,087 A 1/1994 Mann
5,279,088 A * 1/1994 Heydon ..... E04H 3/02 52/223.6
5,279,091 A 1/1994 Williams et al.
5,282,615 A 2/1994 Green et al.
5,285,615 A 2/1994 Gilmour
5,307,600 A 5/1994 Simon et al.
5,315,804 A 5/1994 Attalla
5,319,339 A 6/1994 Leupold
5,325,651 A 7/1994 Meyer et al.
5,339,577 A 8/1994 Snyder
5,347,780 A 9/1994 Richards et al.
5,367,850 A 11/1994 Nicholas
5,374,036 A 12/1994 Rogers et al.
5,376,429 A 12/1994 McGroarty
5,390,458 A 2/1995 Menchetti
5,390,465 A 2/1995 Rajecki
5,394,665 A 3/1995 Johnson
5,412,919 A 5/1995 Pellock et al.
5,433,991 A 7/1995 Boyd, Jr. et al.
5,452,551 A 9/1995 Charland et al.
5,454,203 A 10/1995 Turner
5,456,050 A 10/1995 Ward
5,460,864 A 10/1995 Heitkamp
5,471,791 A 12/1995 Keller
5,471,805 A 12/1995 Becker
5,475,961 A 12/1995 Menchetti
5,477,652 A 12/1995 Torrey et al.
5,502,937 A 4/1996 Wilson
5,505,031 A * 4/1996 Heydon ..... E04B 1/7654 52/800.1
5,531,051 A 7/1996 Chenier, Jr. et al.
5,552,185 A 9/1996 De Keyser
5,592,796 A 1/1997 Landers
5,604,024 A 2/1997 von Bonin
5,607,758 A 3/1997 Schwartz
5,644,877 A 7/1997 Wood
5,687,538 A 11/1997 Frobosilo et al.
5,689,922 A 11/1997 Daudet
5,694,726 A 12/1997 Wu
5,709,821 A 1/1998 von Bonin et al.
5,724,784 A 3/1998 Menchetti
5,735,100 A 4/1998 Campbell
5,740,635 A 4/1998 Gil et al.
5,740,643 A 4/1998 Huntley
5,755,066 A * 5/1998 Becker ..... E04B 2/825 52/241
5,765,332 A 6/1998 Landin et al.
5,787,651 A 8/1998 Horn et al.
5,797,233 A 8/1998 Hascall
5,798,679 A 8/1998 Pissanetzky
5,806,261 A 9/1998 Huebner et al.
5,820,958 A 10/1998 Swallow
5,822,935 A 10/1998 Mitchell et al.
5,870,866 A 2/1999 Herndon
5,913,788 A 6/1999 Herren
5,921,041 A 7/1999 Egri, II
5,927,041 A 7/1999 Sedlmeier et al.
5,930,963 A 8/1999 Nichols
5,930,968 A 8/1999 Pullman
5,945,182 A 8/1999 Fowler et al.
5,950,385 A 9/1999 Herren
5,968,615 A 10/1999 Schlappa
5,968,669 A 10/1999 Liu et al.
5,970,672 A 10/1999 Robinson
5,974,750 A 11/1999 Landin et al.
5,974,753 A 11/1999 Hsu
6,023,898 A 2/2000 Josey
6,058,668 A 5/2000 Herren
6,061,985 A 5/2000 Kraus et al.
6,110,559 A 8/2000 De Keyser
6,116,404 A 9/2000 Heuft et al.
6,119,411 A 9/2000 Mateu Gil et al.
6,128,874 A 10/2000 Olson et al.
6,128,877 A 10/2000 Goodman et al.
6,131,352 A 10/2000 Barnes et al.
6,151,858 A 11/2000 Ruiz et al.
6,153,668 A 11/2000 Gestner et al.
6,176,053 B1 1/2001 St. Germain
6,182,407 B1 2/2001 Turpin et al.
6,189,277 B1 2/2001 Boscamp
6,207,077 B1 3/2001 Burnell-Jones
6,207,085 B1 3/2001 Ackerman
6,213,679 B1 4/2001 Frobosilo et al.
6,216,404 B1 4/2001 Vellrath
6,233,888 B1 5/2001 Wu
6,256,948 B1 7/2001 Van Dreumel
6,256,960 B1 7/2001 Babcock et al.
6,256,980 B1 7/2001 Lecordix et al.
6,279,289 B1 8/2001 Soder et al.
6,305,133 B1 10/2001 Cornwall
6,318,044 B1 11/2001 Campbell
6,374,558 B1 4/2002 Surowiecki
6,381,913 B2 5/2002 Herren
6,405,502 B1 6/2002 Cornwall
6,408,578 B1 6/2002 Tanaka et al.
6,430,881 B1 8/2002 Daudet et al.
6,470,638 B1 10/2002 Larson
6,487,825 B1 12/2002 Silik
6,574,930 B2 6/2003 Kiser
6,595,383 B2 7/2003 Pietrantoni
6,606,831 B2 8/2003 Degelsegger
6,647,691 B2 11/2003 Becker et al.
6,668,499 B2 12/2003 Degelsegger
6,679,015 B1 1/2004 Cornwall
6,688,056 B2 2/2004 von Hoyningen Huene et al.
6,688,499 B2 2/2004 Zhang
6,698,146 B2 3/2004 Morgan et al.
6,705,047 B2 3/2004 Yulkowski
6,708,627 B1 * 3/2004 Wood ..... A47B 96/02 108/42
6,711,871 B2 3/2004 Beirise et al.
6,732,481 B2 5/2004 Stahl, Sr.
6,739,926 B2 5/2004 Riach et al.
6,748,705 B2 6/2004 Orszulak
6,783,345 B2 8/2004 Morgan et al.
6,792,733 B2 9/2004 Wheeler et al.
6,799,404 B2 10/2004 Spransy
6,843,035 B1 1/2005 Glynn
6,854,237 B2 2/2005 Surowiecki
6,871,470 B1 3/2005 Stover
6,944,997 B2 9/2005 Verkamp
6,951,162 B1 10/2005 Shockey et al.
6,996,944 B2 2/2006 Shaw
7,043,880 B2 5/2006 Morgan et al.
7,059,092 B2 6/2006 Harkins et al.
7,104,024 B1 9/2006 deGirolamo et al.
7,152,385 B2 12/2006 Morgan et al.
7,191,845 B2 3/2007 Loar
7,240,905 B1 7/2007 Stahl
7,251,918 B2 8/2007 Reif et al.
7,284,355 B2 10/2007 Becker et al.
7,302,776 B2 12/2007 Duncan et al.
7,398,856 B2 7/2008 Foster et al.
7,413,024 B1 8/2008 Simontacchi et al.
7,441,565 B2 10/2008 Imamura et al.
7,487,591 B2 2/2009 Harkins et al.
7,497,056 B2 3/2009 Surowiecki
7,506,478 B2 3/2009 Bobenhausen
7,513,082 B2 4/2009 Johnson

(56) References Cited

U.S. PATENT DOCUMENTS 7,540,118 B2 6/2009 Jensen
7,594,331 B2 9/2009 Andrews et al.
7,603,823 B2 10/2009 Cann
7,610,725 B2 11/2009 Willert
7,617,643 B2 11/2009 Pilz et al.
7,681,365 B2 3/2010 Klein
7,685,792 B2 3/2010 Stahl, Sr. et al.
7,716,891 B2 5/2010 Radford
7,735,295 B2 * 6/2010 Surowiecki ..... E04B 2/821 52/241
7,752,817 B2 7/2010 Pilz et al.
7,770,348 B2 8/2010 Tollenaar
7,775,006 B2 8/2010 Giannos
7,776,170 B2 8/2010 Yu et al.
7,797,893 B2 9/2010 Stahl, Sr. et al.
7,810,295 B2 10/2010 Thompson
7,814,718 B2 10/2010 Klein
7,827,738 B2 11/2010 Abrams et al.
7,836,652 B2 11/2010 Futterman
7,866,108 B2 1/2011 Klein
7,870,698 B2 1/2011 Tonyan et al.
7,921,537 B2 4/2011 Rodlin
7,921,614 B2 4/2011 Fortin et al.
7,941,981 B2 5/2011 Shaw
7,950,198 B2 5/2011 Pilz et al.
7,966,778 B2 6/2011 Klein
7,984,592 B1 7/2011 Jiras
8,029,345 B2 10/2011 Messmer et al.
8,056,293 B2 11/2011 Klein
8,061,099 B2 11/2011 Andrews
8,062,108 B2 11/2011 Carlson et al.
8,069,625 B2 12/2011 Harkins et al.
8,074,412 B1 12/2011 Gogan et al.
8,074,416 B2 12/2011 Andrews
8,079,188 B2 * 12/2011 Swartz ..... E04H 9/10 52/281
8,087,205 B2 1/2012 Pilz et al.
8,096,084 B2 * 1/2012 Studebaker ..... F16B 35/048 52/319
8,100,164 B2 1/2012 Goodman et al.
8,132,376 B2 3/2012 Pilz et al.
8,136,314 B2 3/2012 Klein
8,151,526 B2 4/2012 Klein
8,181,404 B2 5/2012 Klein
8,225,581 B2 7/2012 Strickland et al.
8,281,552 B2 10/2012 Pilz et al.
8,286,397 B2 10/2012 Shaw
8,318,304 B2 11/2012 Valenziano
8,322,094 B2 12/2012 Pilz et al.
8,353,139 B2 1/2013 Pilz
8,375,666 B2 2/2013 Stahl, Jr. et al.
8,389,107 B2 3/2013 Riebel et al.
8,413,394 B2 4/2013 Pilz et al.
8,468,759 B2 6/2013 Klein
8,495,844 B1 7/2013 Johnson
8,499,512 B2 8/2013 Pilz et al.
8,541,084 B2 9/2013 Deiss et al.
8,544,226 B2 10/2013 Rubel
8,555,566 B2 10/2013 Pilz et al.
8,578,672 B2 11/2013 Mattox et al.
8,584,415 B2 11/2013 Stahl, Jr. et al.
8,590,231 B2 11/2013 Pilz
8,595,999 B1 12/2013 Pilz et al.
8,596,019 B2 12/2013 Aitken
8,601,760 B2 12/2013 Hilburn
8,607,519 B2 12/2013 Hilburn
8,640,415 B2 2/2014 Pilz et al.
8,646,235 B2 2/2014 Hilburn, Jr.
8,671,632 B2 3/2014 Pilz et al.
8,728,608 B2 5/2014 Maisch
8,782,977 B2 7/2014 Burgess
8,793,947 B2 8/2014 Pilz et al.
8,826,599 B2 9/2014 Stahl
8,871,326 B2 10/2014 Flennert
8,938,922 B2 1/2015 Pilz et al.
8,950,132 B2 2/2015 Collins et al.
8,955,275 B2 2/2015 Stahl, Jr.
8,973,319 B2 3/2015 Pilz et al.
9,045,899 B2 6/2015 Pilz et al.
9,127,454 B2 9/2015 Pilz et al.
9,151,042 B2 10/2015 Simon et al.
9,157,232 B2 10/2015 Stahl, Jr.
9,163,444 B1 * 10/2015 Fontijn ..... E05D 15/0621
9,206,596 B1 12/2015 Robinson
9,284,730 B2 3/2016 Klein
9,290,932 B2 3/2016 Pilz et al.
9,290,934 B2 3/2016 Pilz et al.
9,316,133 B2 4/2016 Schnitta
9,371,644 B2 6/2016 Pilz et al.
9,458,628 B2 10/2016 Pilz et al.
9,481,998 B2 11/2016 Pilz et al.
9,506,246 B2 * 11/2016 Joseph ..... E04B 2/7401
9,512,614 B2 12/2016 Klein et al.
9,523,193 B2 12/2016 Pilz
9,551,148 B2 1/2017 Pilz
9,616,259 B2 4/2017 Pilz et al.
9,637,914 B2 5/2017 Pilz et al.
9,683,364 B2 6/2017 Pilz et al.
9,719,253 B2 8/2017 Stahl, Jr. et al.
9,739,052 B2 8/2017 Pilz et al.
9,739,054 B2 8/2017 Pilz et al.
9,752,318 B2 9/2017 Pilz
9,879,421 B2 1/2018 Pilz
9,885,178 B1 2/2018 Barnes et al.
9,909,298 B2 3/2018 Pilz
9,931,527 B2 4/2018 Pilz et al.
9,995,039 B2 6/2018 Pilz et al.
10,000,923 B2 6/2018 Pilz
10,010,805 B2 7/2018 Maxam et al.
10,011,983 B2 7/2018 Pilz et al.
10,077,550 B2 9/2018 Pilz
10,166,418 B2 1/2019 Foerg et al.
10,174,499 B1 1/2019 Tinianov et al.
10,184,246 B2 1/2019 Pilz et al.
10,214,901 B2 2/2019 Pilz et al.
10,227,775 B2 3/2019 Pilz et al.
10,246,871 B2 4/2019 Pilz
10,323,409 B1 6/2019 Robinson
10,323,411 B2 6/2019 Ackerman et al.
10,406,389 B2 9/2019 Pilz et al.
10,472,819 B2 11/2019 Klein et al.
10,494,818 B2 12/2019 Maziarz
10,563,399 B2 2/2020 Pilz et al.
10,619,347 B2 4/2020 Pilz et al.
10,626,598 B2 4/2020 Klein
10,669,710 B2 6/2020 Förg
10,689,842 B2 6/2020 Pilz
10,731,338 B1 8/2020 Zemler et al.
10,753,084 B2 8/2020 Pilz et al.
10,900,223 B2 1/2021 Pilz
10,914,065 B2 2/2021 Pilz
10,920,416 B2 2/2021 Klein et al.
10,954,670 B2 3/2021 Pilz
11,041,306 B2 6/2021 Pilz et al.
11,060,283 B2 7/2021 Pilz et al.
11,111,666 B2 9/2021 Pilz
11,118,346 B2 9/2021 Klein et al.
11,141,613 B2 10/2021 Pilz et al.
11,162,259 B2 11/2021 Pilz
11,230,839 B2 1/2022 Klein et al.
11,268,274 B2 3/2022 Pilz
11,299,884 B2 4/2022 Stahl, Jr. et al.
11,313,121 B2 * 4/2022 Quirijns ..... E04B 2/828
11,401,711 B2 8/2022 Klein
11,421,417 B2 8/2022 Pilz et al.
11,466,449 B2 10/2022 Pilz et al.
11,486,150 B2 * 11/2022 Stahl ..... E04F 19/061
11,512,464 B2 * 11/2022 Klein ..... B32B 9/007
11,560,712 B2 1/2023 Pilz et al.
11,674,304 B2 * 6/2023 Landreth ..... E04B 1/2403 52/272
11,697,937 B2 7/2023 Campbell
11,713,572 B2 * 8/2023 Zemler ..... E04B 1/7675 52/396.01

(56) References Cited

U.S. PATENT DOCUMENTS 11,773,587 B2 10/2023 Pilz et al.
2002/0029535 A1 3/2002 Loper
2002/0095908 A1 7/2002 Kiser
2002/0160149 A1 10/2002 Garofalo
2002/0170249 A1 11/2002 Yulkowski
2003/0079425 A1 5/2003 Morgan et al.
2003/0089062 A1 5/2003 Morgan et al.
2003/0196401 A1 10/2003 Surowiecki
2003/0213211 A1 11/2003 Morgan et al.
2004/0010998 A1 1/2004 Turco
2004/0016191 A1 1/2004 Whitty
2004/0045234 A1 3/2004 Morgan et al.
2004/0139684 A1 7/2004 Menendez
2004/0149390 A1 8/2004 Monden et al.
2004/0157012 A1 8/2004 Miller et al.
2004/0211150 A1 10/2004 Bobenhausen
2005/0031843 A1 2/2005 Robinson et al.
2005/0183361 A1 8/2005 Frezza
2005/0246973 A1 11/2005 Jensen
2006/0032163 A1 2/2006 Korn
2006/0096200 A1* 5/2006 Daudet ..... E04B 1/24 52/272
2006/0123723 A1 6/2006 Weir et al.
2006/0137293 A1* 6/2006 Klein ..... E04B 2/7411 52/782.1
2006/0213138 A1 9/2006 Milani et al.
2006/0261223 A1* 11/2006 Orndorff ..... E04B 2/7409 248/220.1
2006/0277841 A1 12/2006 Majusiak
2007/0056245 A1 3/2007 Edmondson
2007/0068101 A1 3/2007 Weir et al.
2007/0125027 A1* 6/2007 Klein ..... E04B 2/7854 52/481.1
2007/0130873 A1 6/2007 Fisher
2007/0175140 A1 8/2007 Giannos
2007/0193202 A1 8/2007 Rice
2007/0261343 A1 11/2007 Stahl, Sr. et al.
2008/0053013 A1* 3/2008 Tollenaar ..... E04B 2/7457 52/212
2008/0087366 A1 4/2008 Yu et al.
2008/0134589 A1 6/2008 Abrams et al.
2008/0172967 A1 7/2008 Hilburn
2008/0196337 A1 8/2008 Surowiecki
2008/0250738 A1 10/2008 Howchin
2009/0107064 A1* 4/2009 Bowman ..... E04B 1/26 52/238.1
2009/0197060 A1 8/2009 Cho
2009/0223159 A1 9/2009 Colon
2009/0241465 A1* 10/2009 Majors ..... E06B 1/30 52/784.11
2009/0282760 A1 11/2009 Sampson et al.
2010/0071292 A1 3/2010 Futterman
2010/0199583 A1 8/2010 Behrens et al.
2010/0266781 A1 10/2010 Kusinski et al.
2011/0011019 A1 1/2011 Stahl, Jr. et al.
2011/0041415 A1 2/2011 Esposito
2011/0056163 A1 3/2011 Kure
2011/0067328 A1 3/2011 Naccarato et al.
2011/0099928 A1 5/2011 Klein et al.
2011/0113709 A1 5/2011 Pilz et al.
2011/0123801 A1 5/2011 Valenciano
2011/0146180 A1 6/2011 Klein
2011/0167742 A1 7/2011 Klein
2011/0185656 A1 8/2011 Klein
2011/0214371 A1 9/2011 Klein
2011/0247281 A1 10/2011 Pilz et al.
2011/0262720 A1 10/2011 Riebel et al.
2011/0274886 A1* 11/2011 Flennert ..... E04C 2/043 428/174
2011/0302857 A1 12/2011 McClellan et al.
2012/0023846 A1 2/2012 Mattox et al.
2012/0180414 A1 7/2012 Burgess
2012/0247038 A1 10/2012 Black
2012/0266550 A1 10/2012 Naccarato et al.
2012/0297710 A1 11/2012 Klein
2013/0031856 A1 2/2013 Pilz et al.
2013/0118102 A1* 5/2013 Pilz ..... E04B 1/948 52/232
2013/0118764 A1 5/2013 Porter
2013/0133844 A1* 5/2013 Smart ..... E06B 3/94 52/745.19
2013/0205694 A1 8/2013 Stahl, Jr.
2014/0219719 A1 8/2014 Hensley et al.
2014/0260017 A1 9/2014 Noble, III
2014/0345886 A1 11/2014 Yano et al.
2015/0086793 A1 3/2015 Kreysler et al.
2015/0135622 A1 5/2015 Muenzenberger et al.
2015/0135631 A1 5/2015 Foerg
2015/0275506 A1 10/2015 Klein et al.
2015/0275507 A1 10/2015 Klein et al.
2015/0275510 A1 10/2015 Klein et al.
2015/0354210 A1* 12/2015 Stahl, Jr. ..... E04B 2/7409 277/654
2015/0368898 A1 12/2015 Stahl, Jr. et al.
2016/0016381 A1 1/2016 Celis Marin
2016/0017598 A1 1/2016 Klein et al.
2016/0017599 A1 1/2016 Klein et al.
2016/0201893 A1 7/2016 Ksiezppolski
2016/0265219 A1 9/2016 Pilz
2016/0296775 A1 10/2016 Pilz et al.
2016/0348357 A1 12/2016 Smith et al.
2017/0016227 A1 1/2017 Klein
2017/0175386 A1 6/2017 Pilz
2017/0234004 A1 8/2017 Pilz
2017/0234010 A1 8/2017 Klein
2017/0260741 A1 9/2017 Ackerman et al.
2017/0306615 A1 10/2017 Klein et al.
2018/0010333 A1 1/2018 Foerg
2018/0044913 A1 2/2018 Klein et al.
2018/0072922 A1 3/2018 Canale
2018/0171624 A1 6/2018 Klein et al.
2018/0171646 A1 6/2018 Stahl et al.
2018/0195282 A1 7/2018 Pilz
2018/0291619 A1 10/2018 Ackerman et al.
2018/0347189 A1 12/2018 Pilz
2018/0363293 A1 12/2018 Pilz
2019/0284799 A1 9/2019 Förg
2019/0316350 A1 10/2019 Pilz et al.
2019/0323234 A1* 10/2019 Watanabe ..... B32B 13/04
2019/0323347 A1 10/2019 Hensley et al.
2019/0330842 A1 10/2019 Pilz
2019/0344103 A1 11/2019 Pilz
2020/0080300 A1 3/2020 Pilz
2020/0240140 A1 7/2020 Pilz
2020/0284030 A1 9/2020 Pilz
2020/0308829 A1 10/2020 Hunsaker
2020/0340239 A1 10/2020 Chang
2020/0340240 A1 10/2020 Pilz
2020/0362551 A1 11/2020 Klein et al.
2021/0010257 A1 1/2021 Klein et al.
2021/0017761 A1 1/2021 Klein et al.
2021/0040731 A1 2/2021 Pilz
2021/0062502 A1 3/2021 Archer et al.
2021/0101319 A1 4/2021 Klein et al.
2021/0148112 A1 5/2021 Klein
2021/0189721 A1 6/2021 Klein et al.
2021/0254333 A1 8/2021 Pilz
2021/0285208 A1 9/2021 Pilz
2021/0396004 A1 12/2021 Pilz
2022/0010553 A1 1/2022 Pilz et al.
2022/0023684 A1 1/2022 Pilz et al.
2022/0042303 A1 2/2022 Pilz
2022/0056686 A1 2/2022 Pilz
2022/0098856 A1 3/2022 Pilz
2022/0106785 A1* 4/2022 Klein ..... E04B 1/76
2022/0154456 A1 5/2022 Griffith et al.
2022/0162851 A1 5/2022 Pilz
2022/0259852 A1 8/2022 Pilz
2022/0268017 A1 8/2022 Pilz
2022/0349177 A1 11/2022 Pilz
2022/0401767 A1 12/2022 Pilz

(56) References Cited

U.S. PATENT DOCUMENTS

| | | | |
|---|---|---|---|
| 2023/0114420 | A1 | 4/2023 | Pilz et al. |
| 2023/0115315 | A1 | 4/2023 | Pilz et al. |
| 2023/0203807 | A1 | 6/2023 | Pilz et al. |

FOREIGN PATENT DOCUMENTS

| | | | | | |
|---|---|---|---|---|---|
| CA | 2711659 | | | 2/2012 | |
| CA | 2697295 | | | 12/2013 | |
| CA | 2736834 | | | 12/2015 | |
| CA | 2803439 | | | 3/2017 | |
| CA | 3010414 | | | 8/2017 | |
| CA | 2 961 638 | | | 9/2017 | |
| CA | 2827183 | | | 7/2018 | |
| CA | 3036429 | | | 9/2019 | |
| CA | 3041494 | | | 10/2019 | |
| CA | 2 802 579 | | | 3/2020 | |
| CA | 3058865 | | | 7/2020 | |
| CA | 3080978 | | | 11/2020 | |
| DE | 2645807 | B1 | | 3/1978 | |
| DE | 60213279 | T2 | | 7/2007 | |
| EP | 0 335 347 | | | 10/1989 | |
| EP | 0 346 126 | | | 12/1989 | |
| EP | 0509701 | A1 | | 10/1992 | |
| EP | 3 196 376 | | | 7/2017 | |
| EP | 3 348 729 | | | 7/2018 | |
| EP | 3 556 957 | A1 | | 10/2019 | |
| GB | 2 159 051 | | | 11/1985 | |
| GB | 2239213 | A | * | 6/1991 | ..... A62C 2/06 |
| GB | 2 411 212 | | | 8/2005 | |
| GB | 2 424 658 | | | 10/2006 | |
| GB | 2494721 | A | * | 3/2013 | ..... E04B 1/7675 |
| JP | 06-042090 | A | | 2/1994 | |
| JP | 06-146433 | | | 5/1994 | |
| JP | 06-220934 | | | 8/1994 | |
| JP | H06-220934 | | | 8/1994 | |
| JP | 07-4620 | U | | 1/1995 | |
| KR | 100664665 | B1 | | 1/2007 | |
| KR | 20190068167 | A | * | 6/2019 | ..... E04B 1/948 |
| WO | WO 2003/038206 | | | 5/2003 | |
| WO | WO 2004/071584 | | | 8/2004 | |
| WO | WO 2007/103331 | | | 9/2007 | |
| WO | WO 2009/026464 | | | 2/2009 | |
| WO | WO 2013/113734 | | | 8/2013 | |
| WO | WO 2017/129398 | | | 1/2017 | |
| WO | WO 2019/108295 | | | 6/2019 | |

OTHER PUBLICATIONS

U.S. Appl. No. 17/304,451, filed Jun. 21, 2021 Pilz et al.
U.S. Appl. No. 17/305,653, filed Jul. 12, 2021 Pilz et al.
Australian Office Action, re AU Application No. 2019213363, dated May 26, 2020.
Australian Office Action, re AU Application No. 2019250152, dated Jul. 10, 2020.
Canadian First Office Action for Application No. 2,697,295, dated Sep. 21, 2011, in 4 pages.
Canadian Second Office Action for Application No. 2,697,295, dated May 23, 2012, in 4 pages.
Canadian Office Action for Application No. 2,827,183, dated Mar. 27, 2015 in 4 pages.
Canadian Office Action for Application No. 2,827,183, dated Mar. 7, 2016 in 4 pages.
Canadian Office Action for Applicaton No. 2,802,579, dated Jan. 3, 2019 in 3 pages.
Canadian Office Action for Application No. 3,036,429, dated Apr. 8, 2020, in 4 pages.
Canadian Office Action re Application No. 3,052,184, dated Jul. 14, 2021.
Canadian Office Action re Application No. 3,080,978, dated Jun. 17, 2021.
Catalog page from Stockton Products, printed from www.stocktonproducts.com, on Dec. 16, 2007, showing #5 Drip, in 1 page.
ClarkDietrich Building Systems, Product Submittal Sheet, (FTSC) Flat Trail Vertical Slide Clip. CD-FTSC11 Jul. 2011. 1 page.
DoubleTrackTM information sheets by Dietrich Metal Framing, in 2 pages; accessible on Internet Wayback Machine on Jul. 8, 2006.
FireStikTM by CEMCO Brochure, published on www.firestik.us, in 18 pages; accessible on Internet Wayback Machine on Aug. 13, 2007.
Information Disclosure Statement letter; U.S. Appl. No. 12/196,115, dated Aug. 4, 2011.
International Search Report for Application No. PCT/US2008/073920, dated Apr. 9, 2009.
"Intumescent Expansion Joint Seals", Astroflame; http://www.astroflame.com/intumescent_expansion_joint_seals; Jul. 2011; 4 pages.
James A. Klein's Answer, Affirmative Defenses and Counterclaims to Third Amended Complaint; U.S. District Court, Central District of California; Case No. 2:12-cv-10791-DDP-MRWx; Filed Sep. 17, 2014; pp. 1-37.
Letter from Thomas E. Loop; counsel for defendant; Jun. 26, 2015.
Expert Report of James William Jones and exhibits; Case No. CV12-10791 DDP (MRWx); May 18, 2015.
Letter from Ann G. Schoen of Frost Brown Todd, LLC; Jun. 24, 2015.
"System No. HW-D-0607", May 6, 2010, Metacaulk, www.rectorseal.com, www.metacault.com; 2008 Underwriters Laboratories Inc.; 2 pages.
Trim-Tex, Inc., TRIM-TEX Wall Mounted Deflection Bead Installation Instructions, 2 pages. [Undated. Applicant requests that the Examiner review and consider the reference as prior art for the purpose of examination.].
"Wall Mounted Deflection Bead," Trim-Tex Drywall Products; Oct. 9, 2016; 3 pages.
U.S. Appl. No. 17/446,947, filed Sep. 3, 2021 Pilz.
U.S. Appl. No. 17/303,173, filed May 21, 2021 Pilz et al.
U.S. Appl. No. 17/445,393, filed Aug. 18, 2021 Pilz.
U.S. Appl. No. 17/453,158, filed Nov. 1, 2021 Pilz.
BlazeFrame 2009 catalog of products, available at least as of Mar. 4, 2010 from www.blazeframe.com, in 20 pages.
Canadian Notice of Allowance re Application No. 3,058,865, dated Jul. 27, 2021.
U.S. Appl. No. 17/655,738, filed Mar. 21, 2022, Pilz.
U.S. Appl. No. 17/822,091, filed Aug. 24, 2022, Pilz.

* cited by examiner

FIRE-RATED WALL JOINT COMPONENT AND RELATED ASSEMBLIES

CROSS-REFERENCE

This application claims the benefit of U.S. Application No. 62/942,423 filed on Dec. 2, 2019, the entirety of which is hereby incorporated by reference.

BACKGROUND

Field

This application is directed to fire-rated wall construction components for use in building construction joints.

Related Art

Fire-rated wall construction components and assemblies are commonly used in the building construction industry. These components and assemblies are aimed at preventing fire, heat, and smoke from leaving one portion of a building or room and entering another, usually through vents, joints in walls, or other openings. The components can incorporate fire-retardant materials which substantially block the path of the fire, heat, and/or smoke for at least some period of time in accordance with certain standards, such as UL-2079 "Test For Fire-rated Building Joints".

Conventional fire-rated wall construction components are typically labor intensive and expensive to install. One example of a conventional fire block arrangement includes using a fire-resistant material such as mineral wool stuffed in the gaps within a head-of-wall assembly including deflection gaps between the top of the wall boards and the ceiling. Once the gaps are filled with the fire block material, a flexible coating such as a spray-on elastomeric coating can cover the entire head-of-wall to secure the fire block material in place. Over time and cycles of movement the flexible coating may degrade and cause cracks or flaking. As a result, it is possible that the fire-resistant material may become dislodged and thereby reduce the effectiveness of the fire block.

SUMMARY

One aspect of the present disclosure is a fire-rated component for a linear gap between a wall assembly and an adjacent structure. The component includes an elongate metal profile and a fire-rated board member. The elongate metal profile includes a vertical leg, an upper leg and a lower leg. The upper leg extends in a first direction from an upper edge of the vertical leg. The lower leg extends in the first direction from a lower edge of the vertical leg. The fire-rated board member is positioned within a space defined by the vertical leg, the upper leg and the lower leg to form a composite component.

According to another aspect, the upper leg includes a downward facing v-groove. According to another aspect, the upper leg includes an extended free end attachment leg. According to another aspect, an outward facing protrusion on the vertical leg rests against the drywall board of the framed wall assembly with the outward facing protrusion extending in a second direction, opposite the first direction. According to another aspect, the gypsum board member is adhesively attached with the vertical leg. According to another aspect, the lower leg includes a kick-out configured to retain a gypsum board member within the space. According to another aspect, the upper leg, the lower leg, the v-groove, and the kick-out are configured to exert a force against the gypsum board member to retain the gypsum board in the space. According to another aspect, the lower leg determines the thickness of the layer or layers of the gypsum board member. According to another aspect, the metal profile is formed from a unitary piece of sheet steel and bent to form the vertical leg. According to another aspect, the board member comprises a gypsum material.

In another aspect of the present disclosure, a building construction joint includes a wall assembly and an adjacent structure formed along a linear gap. A fire-rated component including an elongate metal profile and a fire-rated board member is positioned at a joint between the wall assembly and the adjacent structure to provide fire-blocking across the linear gap. According to another aspect, the adjacent structure is a ceiling and the wall assembly is a vertical wall.

The foregoing summaries are illustrative only and are not intended to be limiting. Other aspects, features, and advantages of the systems' devices and methods and/or other subject matter described in this application will become apparent in the teaching set forth below. The summaries provided introduce a selection of some of the concepts of this disclosure. The summary is not intended to identify key or essential features of any subject matter described herein.

BRIEF DESCRIPTION OF THE DRAWINGS

Various examples are depicted in the accompanying drawings for illustrative purposes and should in no way be interpreted as limiting the scope of the examples. Various features of different disclosed examples can be combined to form additional examples which are part of this disclosure.

DETAILED DESCRIPTION

Figure 1:
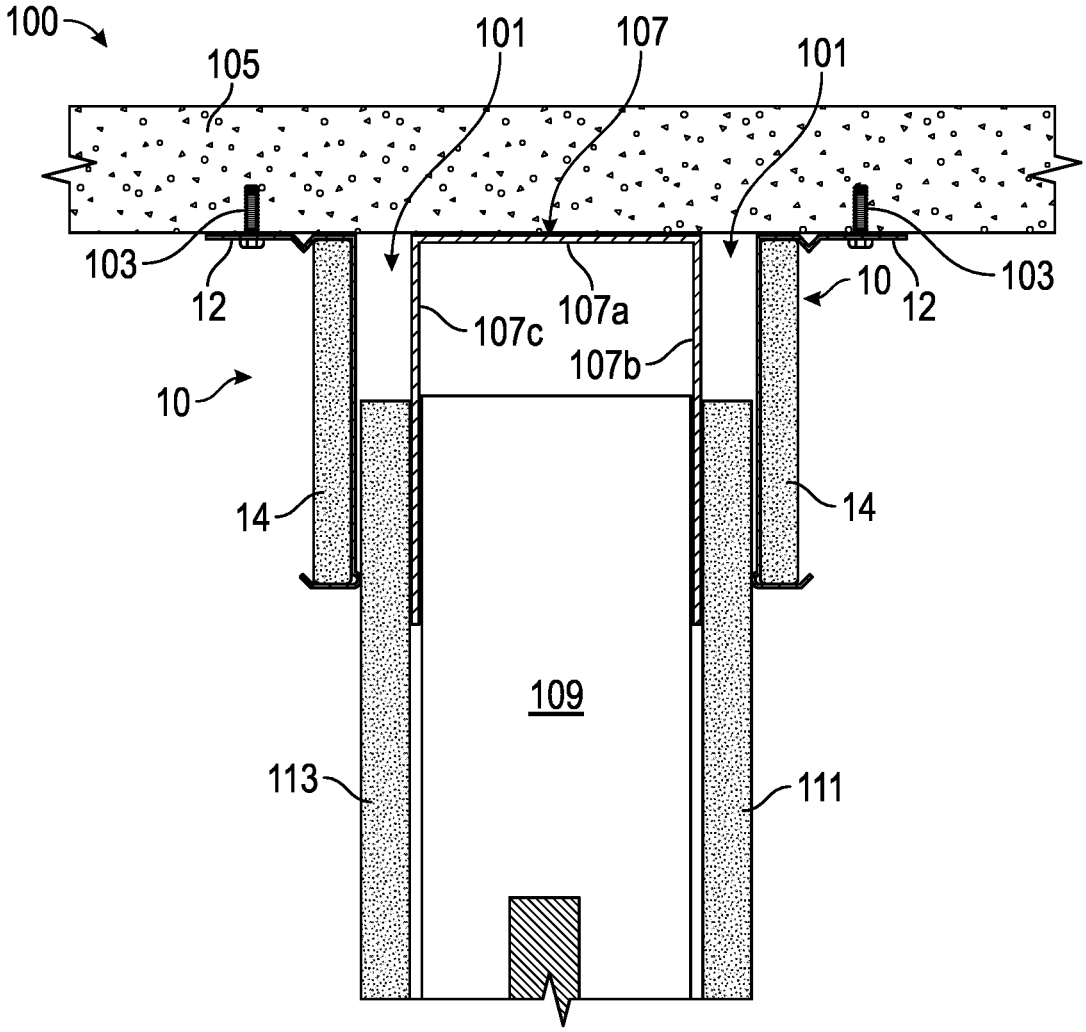
FIG. 1 illustrates a cross section of a head-of-wall assembly including a composite fire-blocking component.
Figure 2A:
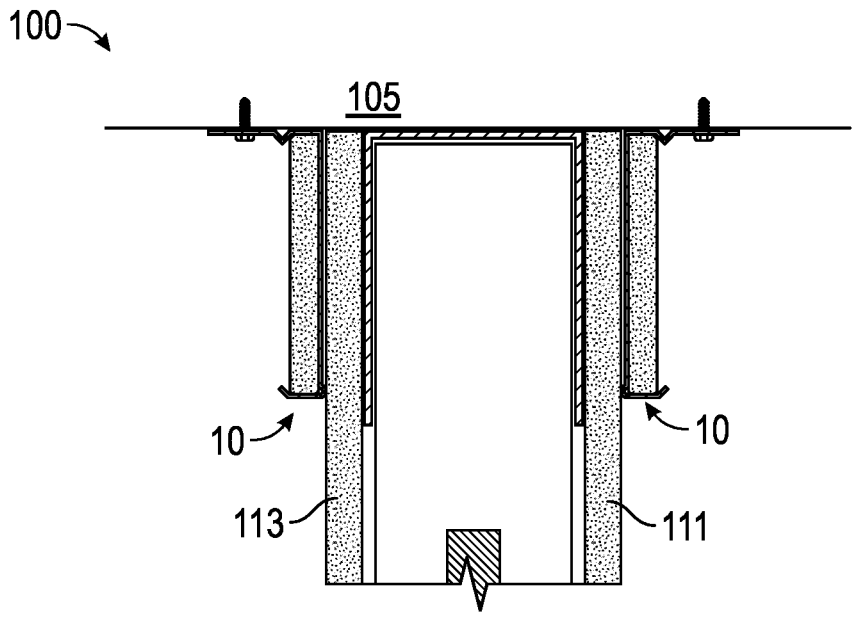
FIG. 2A shows a cross-section of the head-of-wall assembly in a fully closed configuration.
Figure 2B:
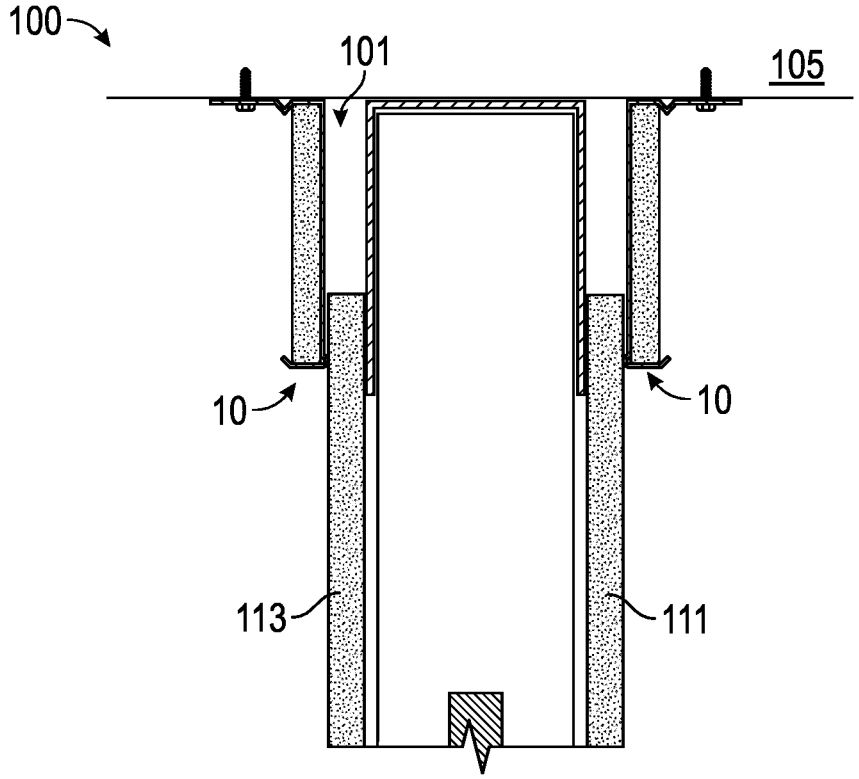
FIG. 2B shows a cross-section of the head-of-wall assembly in a fully opened configuration.

FIGS. 1-2B illustrate a building construction joint between a wall assembly and an adjacent structure having a linear gap in the form of a head-of-wall assembly 100. The embodiments disclosed herein often are described in the context of an interior of a building and configured for preventing passage of smoke and/or fire between adjacent rooms in an elevated-temperature environment. However, the embodiments herein can be applied to wall systems configured for other types of environments as well, such as for exterior wall applications, and can include different and/or additional components and types of materials other than those described herein.

The head-of-wall assembly 100 can generally include an overhead structure or ceiling 105. The ceiling 105 can be generally formed in a horizontal plane and/or include one or more flutes or grooves therein. The ceiling 105 can be a floor of a higher level of a building. The head-of-wall assembly 100 can include a header track or channel 107. The channel 107 can include a web 107*a* to which are attached one or more flanges 107*b*, 107*c*. The first and second flanges 107*b*, 107*c* can extend from opposite ends of the web 107*a* in the same direction to form a generally u-shaped cross section. Optionally, the channel 107 can be a deep leg header track.

One or more studs 109 forming the wall can be received within the channel 107 between the first and second flanges 107*b*, 107*c*. The first and second flanges 107*b*, 107*c* can include slots to which fasteners can be received to attach the channel 107 with the studs 109. The slots can be oriented generally orthogonal to a length of the channel 107. The studs 109 can be attached with the channel 107 via fasteners through the slots of the flanges 107*b*, 107*c*.

One or more wall board members (e.g., gypsum drywall) 111, 113 can be attached with the studs 109 to form the wall. Assembly of the wall boards 111, 113 with the studs 109 can define a deflection gap 101 between the ceiling 105 and upper ends of the wall boards 111, 113. The deflection gap 101 can vary in width depending on the relative position of the wall (e.g., wall boards 111, 113 and the studs 109) and the ceiling 105. The head-of-wall assembly 100 can cycle between a more closed position (such as the fully closed position in FIG. 2A) and a more open position (such as the fully open position in FIG. 2B). The dynamic nature of the head-of-wall assembly 100 can accommodate seismic or thermal forces or other movements of the building within which the head-of-wall assembly 100 is included.

The head-of-wall assembly 100 can include a fire-rated composite component 10. The composite component 10 can generally be configured to cover the deflection gap 101 to provide fire, smoke, heat and/or sound insulation and facilitate unencumbered movement of the joint. The component 10 can include an elongate metal profile 12 and a board member 14. The board member 14 can comprise a fire-rated material, such as a gypsum drywall material. In certain implementations, the board member 14 can adhesively attached or otherwise mechanically secured with the metal profile 12 to form the composite component 10.

The composite component 10 can be installed over the outer surface of the wall boards 111, 113 and/or the flanges 107*b*, 107*c* on the framed wall assembly once the drywall assembly is completed. The component 10 can be attached with the ceiling 105 by one or more fasteners 103, such as metal screws, adhesives, staples or other fasteners. The fasteners 103 can extend through the metal profile 12. The fire board member 14 can insulate the metal profile 12, while the metal profile 12 provides a constant fire block as it will not melt during the fire test of UL 2079. The combination of these two materials provides long lasting fire protection. In addition, drywall used in the board member 14 is less expensive than other fire-resistant materials, such as intumescent materials, that are often used in head-of-wall assemblies or other gaps of a building construction joint.

Figure 3:
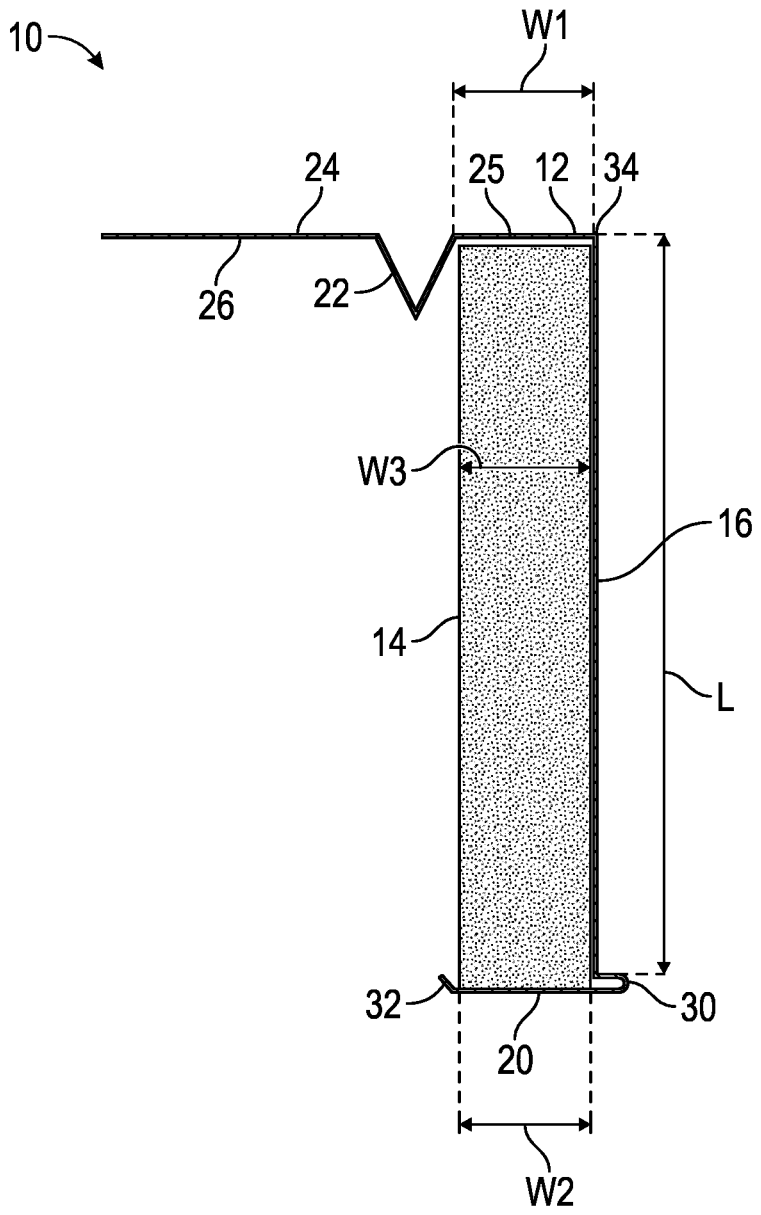
FIG. 3 shows a cross-section of the composite fire-blocking component including a metal profile and board member.

The metal profile 12 can come in standard lengths (e.g., 10', 12', etc.). As shown further in the cross-section of FIG. 3, the metal profile 12 can include a single sheet of metal, such as steel. The metal profile 12 can include a plurality of bends to form the metal profile shape. The metal profile 12 can include, a vertical leg 16, an upper leg 24, and/or a lower leg 20. The vertical leg 16 can have a length L extending from the upper leg 24 to the lower leg 20. The length L can vary depending on the size of the head-of-wall deflection gap 101 and the overall dynamic movement needed. The length L can generally be between about 1" and 6". The vertical leg 16 can comprise a flattened portion of the metal profile 12. Alternatively, the vertical leg 16 can comprise one or more strengthening features such as grooves or ribs.

The upper leg 24 can couple with the vertical leg 16 at a corner 34. The upper leg 24 can generally form perpendicular angle with the vertical leg 16. The upper leg 24 can extend from the corner 34 in a first (e.g., rightward) direction. The upper leg 24 can be a horizontal leg. The upper leg 24 can be approximately 1.5"-3.5" in length.

The upper leg 24 can include a groove 22. The groove 22 can be shaped as a v-groove, u-groove, or other form factor. The groove 22 can include an open end facing upwards and outwards. The groove 22 can provide structural strength to the metal profile 12 and to the upper leg 24. Other retention features and/or strengthening features could also be used. The groove 22 can extend downwardly towards the lower leg 20. The groove 22 can divide the upper leg into an inner portion 25 and an outer portion 26. The inner portion 25 can be in-line with the outer portion 26. The inner portion 25 can have a width W1 from the corner to the groove 22 (e.g., approximately 0.625"). The outer portion 26 can include an attachment portion of the metal profile 12. The outer portion 26 can have a width of approximately 1.25". The attachment can include one or more holes or other mechanism to allow an installer to attach the metal profile 12 to the ceiling 105 (or other adjoining structure).

The lower leg 20 can couple with the vertical leg 16 at a corner 30. The lower leg 20 can generally form perpendicular angle with the vertical leg 16. The lower leg 20 can extend from the corner 30 in the first (e.g., rightward) direction. The lower leg 20 can extend in the same direction as the upper leg 24. The lower leg 20 can be a horizontal leg.

The lower leg 20 can include a kick-out 32. The kickout 32 can be on a free end of the lower leg 20. The kickout 32 can include an upturned retention lip or portion of the lower leg 20 (e.g., towards the upper leg 24). The kick-out 32 can be angled upwardly towards the upper leg 24. The lower leg 20 can include a width W2 from the corner 30 to the free end or the kickout 32. The width W2 can optionally be the same as the width W1.

The lower leg 20, the vertical leg 16, and the upper leg 24 can form an inner, partially enclosed space. The inner space can receive and secure the board member 14. The board member 14 can comprise a fire-rated drywall member. The board member 14 can comprise one or more layers of material. The board member 14 can be a rip of drywall comprising a gypsum material. The board member 14 can include a generally rectangular-shaped profile. The board member 14 can nest within the inner space between the upper leg 24, the vertical leg 16, and the lower leg 20. Preferably, the width W1 of the upper leg 24 and the width W2 of the lower leg 20 can be sized to accommodate a width W3 of the board member 14. The kickout 32 and/or the groove 22 can exert an inward force on the board member 14 to help retain the board member 14 within the inner space and/or against the vertical leg 16. In certain implementations, the width W1 can be the same as width W2 and correspond to the width W3 of the board member 14. The widths W1, W2 can limit the W3 of the board member 14 that can be used in the composite component 10.

An interior side of the board member 14 can be glued to the vertical leg 16 with an adhesive or secured with a mechanical fastener. The adhesive can secure the board member 14 within the inner space of the metal profile 12. The kickout 32 and/or groove 22 can also retain the board member in place within the metal profile and ensure it will not fall out during a fire that may compromise the adhesive. The groove 22 and/or kickout 32 can be shaped in any suitable shape for retention of the board member 14 and/or strengthening of the composite 10.

The corner 30 can include an inward facing protrusion (e.g., towards the wall boards 111, 113) that sticks out further than the interior surface of the vertical leg 16 (e.g., approximately 0.125"). The inward facing protrusion can be formed of a bend in the metal of the metal profile 12. In the installed position with the head-of-wall assembly 100, the protrusion can provide a sealing point against one of the board members 111, 113 of the framed wall assembly. This protrusion can also allow the wall to cycle up and down, as is needed in order to pass the UL-2079 "Test For Fire-rated Building Joints" without causing any damage to the drywall on the framed wall assembly. In other configurations, one or both of the protrusion of the corner 30 and kickout 32 can be omitted.

In the installed configuration within the head-of-wall assembly 100, the board member 14 can be nested within the inner space of the metal profile 12. The upper leg 24 can abut against and attached with the ceiling 105 (e.g., by fastener 103). The vertical leg 16 can abut an upper end of the wall board 113 and cover the deflection gap 101. The protrusion of the corner 30 can abut the outer face of the wall board 113 to provide a seal therewith. The wall board 113 can cycle behind the installed composite component 10 between open and closed configurations.

Figure 4:
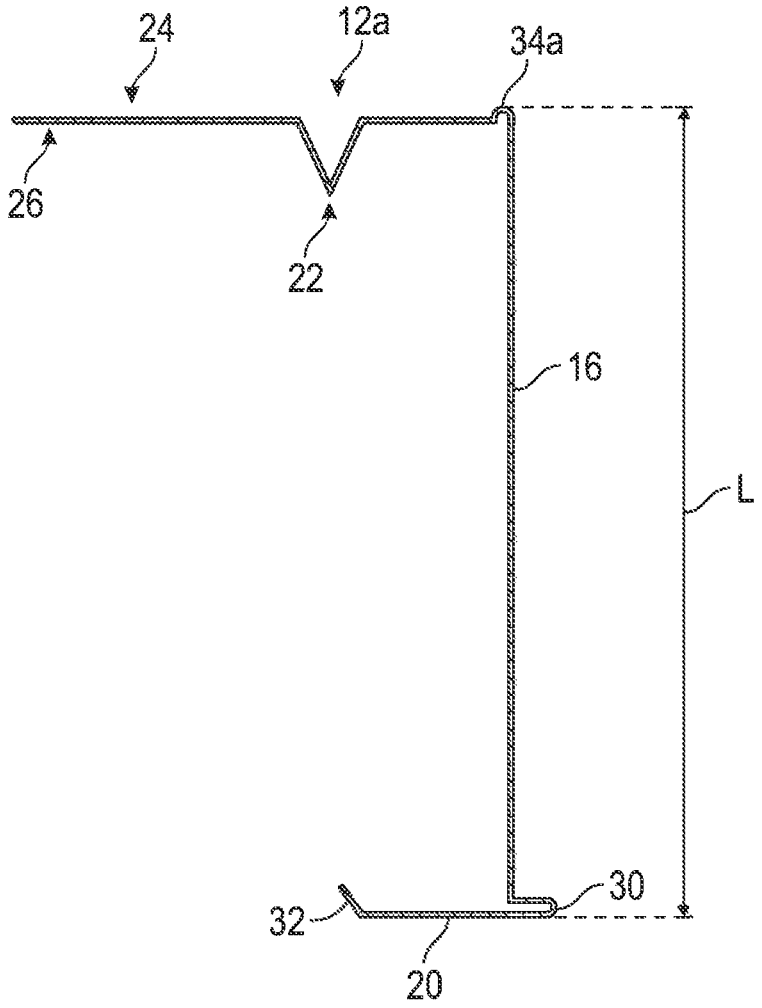
FIG. 4 shows a cross-section of an elongate metal profile.

FIG. 4 illustrates an alternative metal profile 12*a*. The metal profile 12*a* can include a vertical leg 16, an upper leg 24, and a lower leg 20, like the metal profile 12 previously described. An upward facing protrusion 34*a* can be formed of a bent portion of the material of the metal profile 12*a* on the upper leg 24 (e.g., approximately 0.125"). The upward facing protrusion can be directed or extend generally upwardly. In the installed configuration, the protrusion can contact and provide a sealing point against the ceiling 105 of the assembly 100. In the installed configuration within the head-of-wall assembly 100, the upper leg 24 can abut against and attached with the ceiling 105. The upward facing protrusion of the corner 30 can abut the ceiling 105 to provide a seal therewith. The wall board 113 can cycle behind the installed composite component 10 between open and closed configurations.

Certain Terminology

Terms of orientation used herein, such as "top," "bottom," "proximal," "distal," "longitudinal," "lateral," and "end," are used in the context of the illustrated example. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular," "cylindrical," "semi-circular," or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain examples include or do not include, certain features, elements, and/or steps. Thus, such conditional language is not generally intended to imply that features, elements, and/or steps are in any way required for one or more examples.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain examples require the presence of at least one of X, at least one of Y, and at least one of Z.

The terms "approximately," "about," and "substantially" as used herein represent an amount close to the stated amount that still performs a desired function or achieves a desired result. For example, in some examples, as the context may dictate, the terms "approximately," "about," and "substantially," may refer to an amount that is within less than or equal to 10% of the stated amount. The term "generally" as used herein represents a value, amount, or characteristic that predominantly includes or tends toward a particular value, amount, or characteristic. As an example, in certain examples, as the context may dictate, the term "generally parallel" can refer to something that departs from exactly parallel by less than or equal to 20 degrees. All ranges are inclusive of endpoints.

SUMMARY

Several illustrative examples of construction joints have been disclosed. Although this disclosure has been described in terms of certain illustrative examples and uses, other examples and other uses, including examples and uses which do not provide all of the features and advantages set forth herein, are also within the scope of this disclosure. Components, elements, features, acts, or steps can be arranged or performed differently than described and components, elements, features, acts, or steps can be combined, merged, added, or left out in various examples. All possible combinations and subcombinations of elements and components described herein are intended to be included in this disclosure. No single feature or group of features is necessary or indispensable.

Certain features that are described in this disclosure in the context of separate implementations can also be implemented in combination in a single implementation. Conversely, various features that are described in the context of a single implementation also can be implemented in multiple implementations separately or in any suitable subcombination. Moreover, although features may be described above as acting in certain combinations, one or more features from a claimed combination can in some cases be excised from the combination, and the combination may be claimed as a subcombination or variation of a subcombination.

Any portion of any of the steps, processes, structures, and/or devices disclosed or illustrated in one example in this disclosure can be combined or used with (or instead of) any other portion of any of the steps, processes, structures, and/or devices disclosed or illustrated in a different example or flowchart. The examples described herein are not intended to be discrete and separate from each other. Combinations, variations, and some implementations of the disclosed features are within the scope of this disclosure.

While operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Additionally, the operations may be rearranged or reordered in some implementations. Also, the separation of various components in the implementations described above should not be understood as requiring such separation in all implementations, and it should be understood that the described components and systems can generally be integrated together in a single product or packaged into multiple products. Additionally, some implementations are within the scope of this disclosure.

Further, while illustrative examples have been described, any examples having equivalent elements, modifications, omissions, and/or combinations are also within the scope of this disclosure. Moreover, although certain aspects, advantages, and novel features are described herein, not necessarily all such advantages may be achieved in accordance with any particular example. For example, some examples within the scope of this disclosure achieve one advantage, or a group of advantages, as taught herein without necessarily achieving other advantages taught or suggested herein. Further, some examples may achieve different advantages than those taught or suggested herein.

Some examples have been described in connection with the accompanying drawings. The figures are drawn and/or shown to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various examples can be used in all other examples set forth herein. Additionally, any methods described herein may be practiced using any device suitable for performing the recited steps.

For purposes of summarizing the disclosure, certain aspects, advantages and features of the inventions have been described herein. Not all, or any such advantages are necessarily achieved in accordance with any particular example of the inventions disclosed herein. No aspects of this disclosure are essential or indispensable. In many examples, the devices, systems, and methods may be configured differently than illustrated in the figures or description herein. For example, various functionalities provided by the illustrated modules can be combined, rearranged, added, or deleted. In some implementations, additional or different processors or modules may perform some or all of the functionalities described with reference to the examples described and illustrated in the figures. Many implementation variations are possible. Any of the features, structures, steps, or processes disclosed in this specification can be included in any example.

In summary, various examples of construction joints and related methods have been disclosed. This disclosure extends beyond the specifically disclosed examples to other alternative examples and/or other uses of the examples, as well as to certain modifications and equivalents thereof. Moreover, this disclosure expressly contemplates that various features and aspects of the disclosed examples can be combined with, or substituted for, one another. Accordingly, the scope of this disclosure should not be limited by the particular disclosed examples described above, but should be determined only by a fair reading of the claims.

The invention claimed is:

1. A fire-rated component for a linear gap between a wall assembly and an adjacent structure, the component comprising:

an elongate metal profile comprising a vertical leg, an upper leg and a lower leg, the upper leg extending in a first direction from an upper edge of the vertical leg, the lower leg extending in the first direction from a lower edge of the vertical leg, wherein the upper leg and the lower leg are configured to be oriented to extend in a direction away from a header track in use;

a fire-rated board member nested between the upper leg and the lower leg;

wherein an upper end of the fire-rated board member is positioned below the upper leg and a lower end of the fire-rated board member is positioned above the lower leg;

wherein the upper leg comprises a first portion connected to the vertical leg, the first portion having a first edge and defining a plane, a second portion having a second edge positioned within the plane, and a downward extending protrusion connecting the first portion to the second portion, wherein the downward extending protrusion is connected to the first portion along the first edge and to the second portion along the second edge.

2. The component of claim 1, further comprising an outward facing protrusion on the vertical leg configured to rest against a drywall board of the wall assembly, the outward facing protrusion extending in a second direction, opposite the first direction.

3. The component of claim 1, wherein the board member is adhesively attached to the vertical leg.

4. The component of claim 1, wherein the lower leg comprises a kickout configured to retain the board member within the elongate metal profile.

5. The component of claim 4, wherein any one or combination of the upper leg, the lower leg, the downward extending protrusion and the kickout are configured to exert a force against the board member to retain the board member within the elongate metal profile.

6. The component of claim 1, wherein a width of the board member is limited by a width of the lower leg.

7. The component of claim 1, wherein the metal profile comprises a single sheet of bent steel.

8. The component of claim 1, wherein the board member comprises a gypsum material.

9. A building construction joint, comprising:

the wall assembly and the adjacent structure with the linear gap extending therebetween; and the component of claim 1 positioned between the wall assembly and the adjacent structure to provide fire-blocking across the linear gap.

10. The building construction joint of claim 9, wherein the adjacent structure is a ceiling.

11. The component of claim 1, further comprising an upward facing protrusion on the upper leg configured to abut the adjacent structure.

12. The component of claim 1, wherein the downward extending protrusion comprises a V-groove.

13. A fire-rated component for a linear gap between a wall assembly and an adjacent structure, the component comprising:

an elongate metal profile comprising:

a vertical leg;

an upper leg comprising a first portion connected to the vertical leg, the first portion having a first edge and defining a plane, a second portion having a second edge positioned within the plane, a groove connecting the first portion to the second portion, wherein the groove is connected to the first portion along the first edge and to the second portion along the second edge; and a lower leg;

wherein the upper leg extends in a first direction from an upper edge of the vertical leg, the lower leg extends in the first direction from a lower edge of the vertical leg, and the groove extends in a second direction from the upper leg, the second direction extending towards the lower leg from the upper leg;

a fire-rated board member nested within a space defined by the elongate metal profile with an upper end of the fire-rated board member positioned between the vertical leg and the groove of the upper leg.

14. The fire-rated component of claim 13, wherein the groove of the upper leg comprises a V-shaped groove between the second portion and the vertical leg.

15. The fire-rated component of claim 13, wherein any one or combination of the upper leg, the lower leg, and the groove of the upper leg exert a force against the board member to retain the board member nested within the elongate metal profile.

16. A fire-rated component for a linear gap between a wall assembly and an adjacent structure, the component comprising:

an elongate metal profile comprising a vertical leg, an upper leg and a lower leg, the upper leg extending in a first direction from an upper edge of the vertical leg, the lower leg extending in the first direction from a lower edge of the vertical leg, and the upper leg spaced from the lower leg by a first vertical length, wherein the upper leg and the lower leg are configured to be oriented to extend in a direction away from a header track in use; and a fire-rated board member nested within a space defined by the elongate metal profile between the upper leg and the lower leg, the fire-rated board member having a second vertical length from an upper end to a lower end of the fire-rated board member, the second vertical length being less than the first vertical length;

wherein the upper leg comprises a first portion, a second portion positioned along a same plane as the first portion, and a downward extending protrusion connecting the first portion to the second portion.

17. The fire-rated component of claim 16, wherein the upper end of the fire-rated board member is positioned between the vertical leg and the downward extending protrusion of the upper leg.

18. The fire-rated component of claim 17, wherein the downward extending protrusion of the upper leg comprises a V-shaped groove between the second portion and the vertical leg.

19. The fire-rated component of claim 17, wherein any one or combination of the upper leg, the lower leg, and the downward extending protrusion exert a force against the board member to retain the board member nested within the elongate metal profile.

* * * * *